United States Patent [19]

Simpson

[11] Patent Number: 4,525,976

[45] Date of Patent: Jul. 2, 1985

[54] METHOD AND APPARATUS FOR ASSEMBLING STANDING SEAM ROOFS

[75] Inventor: Harold G. Simpson, Oklahoma City, Okla.

[73] Assignee: Encon Products, Inc., Oklahoma City, Okla.

[21] Appl. No.: 481,858

[22] Filed: Apr. 4, 1983

[51] Int. Cl.[3] ..... E02D 35/00

[52] U.S. Cl. ..... 52/748; 52/127.7; 52/528; 52/749; 52/DIG. 1

[58] Field of Search ..... 52/749, 747, 127.7, 52/DIG. 1, 748, 528

[56] References Cited

U.S. PATENT DOCUMENTS

| | | | |
|---|---|---|---|
| 3,303,619 | 2/1967 | Janecek | 52/528 X |
| 3,641,729 | 2/1972 | Irvin | 52/528 |
| 4,171,599 | 10/1979 | Lipp | 52/528 |
| 4,187,661 | 2/1980 | Poiry | 52/748 |
| 4,213,282 | 7/1980 | Heckelsberg | 52/528 X |

FOREIGN PATENT DOCUMENTS

| | | | |
|---|---|---|---|
| 793044 | 8/1968 | Canada | 52/528 |

*Primary Examiner*—Carl D. Friedman
*Attorney, Agent, or Firm*—Bill D. McCarthy

[57] ABSTRACT

An apparatus and method for enhancing joint integrity of a seam formed by union of adjacently disposed panels wherein one panel is provided with a female member and the other panel is provided with a male member, the female member being adopted to receive the male member such that a recessed portion is formed within the male member. The apparatus includes a first hand implement positionable within the recessed portion of the male member for selectively exerting a force on the male member for moving same into a seating, substantially watertight sealing relationship with the female member. The apparatus also includes a second hand implement positionable over the female member for exerting a force on the female member in a direction substantially opposite the force exerted on the male member by the first hand implement.

13 Claims, 15 Drawing Figures

METHOD AND APPARATUS FOR ASSEMBLING STANDING SEAM ROOFS

BACKGROUND OF THE INVENTION

1. Field of the Invention

The present invention relates to building assemblies having standing seam roofs, and more particularly but not by way of limitation, to an improved method and apparatus for assembling a standing seam metal roof.

2. Brief Statement of the Prior Art

The pre-engineered building industry has developed into a multi-billion dollar segment of the building construction industry in the United States, and it has experienced an increasingly greater share of the construction industry budget throughout the world. The established method of erecting the roof of a pre-engineered building is to erect the primary structural members; attach the secondary structural members to the primary structural members; secure the appropriate bracing members; roll blanket-type insulation across the secondary structural members; dispose roof panel members over the insulation; and connect the roof panel members to each adjacently disposed roof panel member and to the secondary structural members.

Numerous types of roof assemblies have heretofore been proposed for a pre-engineered building in an effort to provide a watertight roof assembly, while at the same time enabling the roof assembly to expand and contract as changes in temperature are encountered. Typical of such a prior art roof assembly which has met with considerable success in recent years is the standing seam roof assembly. The panel members of the standing seam roof assembly are joined to each other along adjacent sides such that the sides are lapped together to form the standing seams. The panel members of the standing seam roof are secured to the secondary structural members by means of clips. The interconnection of the panel members of the standing seam roof lend stiffness and strength to the roof structure, while allowing the roof structure to expand and contract as a function of the coefficient of expansion of the materials of which the roof panels are made and the temperature cycles to which the roof panels are exposed.

The repeated action of expansion and contraction on the panel members of the roof assembly tends to weaken the panel-to-panel-to-lap joint and thus often causes panels to seperate, structural failure and leaks in the roof assembly. The leaks are generally caused by the weakening of the fastening members and working or kneading of the sealant used at the joints. In many of the prior art roof assemblies, the sealant employed required adhesion, flexibility and water repellency. Further, the design of the joint was in many instances such that the pressure on the sealant varied greatly throughout the length of the sidelap and endlap joints of the panels and resulted in uneven distribution of the sealant and voids in the joints which frequently led to leaks.

Many of the before-mentioned problems encountered in the prior art standing seam roof assemblies, such as structural failures and leaks, have been overcome by the improved standing seam metal floating roof assembly disclosed in copending U.S. patent application Ser. No. 425,477, filed Sept. 28, 1982, now U.S. Pat. No. 4,497,151. The standing seam floating roof assembly of the before-mentioned copending patent application is formed of elongated metal panels, each of which is provided with a female member formed along one side portion of the panel and a male member formed along the opposed side portion of the panel such that adjacent panels are interlocked with the female and male members thereof to form the standing seam. A clip having a slidable upper portion is secured between the standing seam of the roof assembly and the secondary structure such that the upper portion of the clip is disposed between the male and female members of the panels forming a standing seam. The clip is further constructed so that relative motion between the clip and the metal panels is substantially prevented. To assist in the watertightness of the standing seam a resilient material is disposed in the upper portion of the standing seam between the female member and the male member.

The structure and features of the improved standing seam floating roof assembly disclosed in the before-mentioned patent application achieves the objective of providing an improved watertight standing seam floating roof assembly wherein the resilient material is clamped between adjoining male and female members of the panels without the aid of a field-seaming machine or the necessity of assembling and rotating the panel being assembled into a pre-designated position. However, problems may nevertheless be encountered due to human involvement in the construction of the standing seam roof assembly, especially in the formation of a watertight, quality-consistent standing seam by the union of the male member of one panel with the adjacently disposed female member of a second panel. Thus, it is desirable to provide a method and apparatus for assembling such standing seam roof assemblies which substantially eliminates human error encountered in the formation of the standing seam by the union of adjacent roof panels via the male and female members of the standing seam, and which enables one to more readily provide for proper alignment of the male and female members of the standing seam and provide improved standing seam joint integrity.

SUMMARY OF THE INVENTION

The present invention provides an improved method and apparatus for assembling a standing seam roof. Broadly, the present invention provides an apparatus for enhancing joint integrity of a seam formed by union of adjacently disposed panels wherein one panel is provided with a female member and the other panel is provided with a male member such that in an assembled portion of the male and female member a recessed portion is formed within the male member.

In one aspect the apparatus comprises a first hand implement positionable within the recessed portion of the male member for selectively moving the male member into a seating, substantially watertight sealing relationship with the female member upon application of a force on the male member via the first hand implement.

In another aspect the apparatus of the present invention further comprises a second hand implement disposable over the female member of the standing seam so that upon application of a force to the female member via the second hand implement in a direction substantially opposite the force exerted on the male member via the first hand implement the lower portion of the female member frictionally engages the lower end portion of the male member of the standing seam.

In yet another aspect the present invention relates to an improved method for providing joint integrity in a standing seam formed by union of adjacently disposed panels wherein one of the panels is provided with a female member and the other panel is provided with a male member having an upright portion and an extension portion and the female member receives the male member such that a recess is formed in the male member between the upright portion and the extension. Broadly, the improved method for providing joint integrity in a standing seam roof assembly comprises positioning a first hand implement within the recess portion formed in the male member of the standing seam, and applying an effective amount of force to the first hand implement to provide contact between the first hand implement and the extension portion of the male members so that the extension portion is moved in a direction away from the upright portion of the male member and into locking engagement with the female member.

In yet another aspect the present invention relates to an improved method for providing joint integrity in a standing seam which further comprises positioning a second hand implement over at least a portion of the female member so as to be substantially shaped with the first hand implement disposed in the recess portion of the male member, and applying a force on the female member via the second hand implement while force is being applied to the male member in an opposite direction via the first hand implement.

An object of the present invention is to provide an improved method for assembling a standing seam roof wherein adjacently disposed panels are uniformly interlocked without the aid of a field seaming machine or the necessity of preassembling portions of the roof.

Another object of the present invention is to provide a hand implement for assembling a standing seam roof which enables proper alignment of the male and female members forming the standing seam of the roof.

Another object of the present invention is to provide a method and apparatus for readily controlling the joint integrity of a standing seam roof.

Still another object of the present invention is to provide an improved method and apparatus for assembling standing seam roof assemblies which substantially eliminates human error encountered in the joining of adjacent roof panels via male and female members of the standing seam roof assembly.

Other objects, features and advantages of the present invention will become clear from a reading of the following detailed description when read in conjunction with the drawings and the appended claims.

BRIEF DESCRIPTION OF THE DRAWINGS

FIG. 6 is an enlarged, partial sectional view of the standing taken at 6—6 in FIG. 3.

DESCRIPTION

Figure 1:
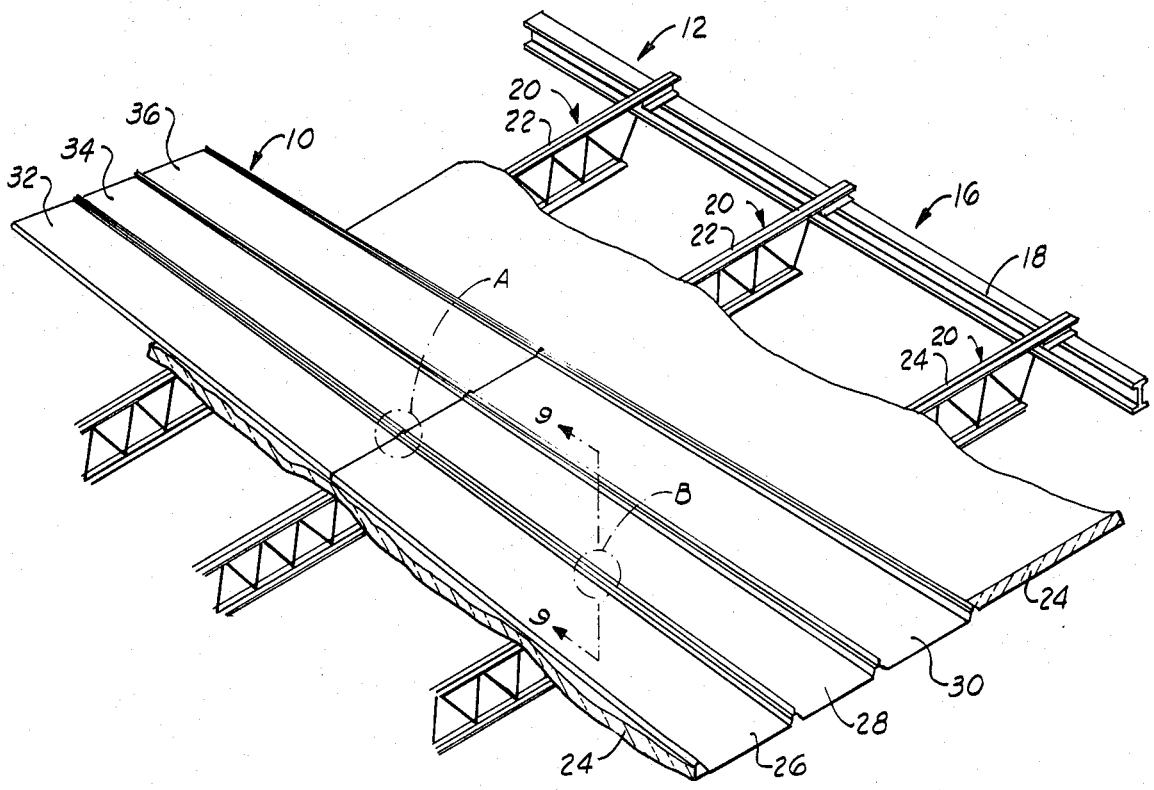
FIG. 1 is a partially broken perspective view of a portion of a standing seam roof assembly.

Referring now to the drawings, and more particularly to FIG. 1, a portion of a building roof 10 is supported by a building structure 12. The building structure 12 comprises a primary structural system 16 which consists of a plurality of upwardly extending column members (not shown) that are rigidly connected to a foundation (also not shown). The primary structural system 12 has a plurality of primary beams 18 (only one being shown) which are generally horizontally disposed and supported by the column members.

A secondary structural system 20 comprises a plurality of open web beams or trusses 22, also referred to as bar joists, which are supported by the primary beams 18 and are also generally horizontally disposed. While Z or C purlins or wood beams could as well be used as the secondary structural members in the practice of the present invention, the present invention will be described with reference to the bar joist 22 shown in FIG. 1.

The bar joist 22 of the secondary structural system 20 supports insulation batts 24 and the building roof 10. The insulating batts 24 may be formed of any suitable insulating material, such as fiberglass, Styrofoam, or the like. The building roof 10, a standing seam roof, is formed of a plurality of panels, such as panels 26, 28, 30, 32, 34 and 36. As illustrated, panels 26 and 28 are joined by a sidelap (shown in greater detail in FIG. 6); whereas roof panels 26 and 32 are joined at their adjacent short ends by an endlap construction (shown in greater detail in FIGS. 2, 3, 4 and 5). Panels 32 and 34 are joined along their sides by a sidelap similar to the junction of panels 26 and 28; and panels 28 and 34 are joined at their short ends in the same manner as panels 26 and 32. The four corners of the junction of panels 26, 28, 32 and 34 in the standing seam portion of the building roof 10 are associated and joined as will be more fully described hereinafter. It is to be understood that other panels of the building roof 10 are joined to adjacent panels in the same manner described above.

The panels described herein comprise a body portion and directionally positioned elements. It is to be understood that the directionally positioned elements, such as upwardly extending members, downwardly extending members and horizontally disposed members are described with reference to the body portion of the panel when the body portion is substantially horizontally disposed.

As previously stated, the building roof 10 is fabricated of a plurality of panels. In order to improve and ensure the water repellency of the building roof 10, a sealant, such as a mastic having desirable adhesion, resiliency, flexibility and water repellency properties, is disposed along portions of the panels which are joined to each other, such as at the endlaps or junctions.

Figure 2:
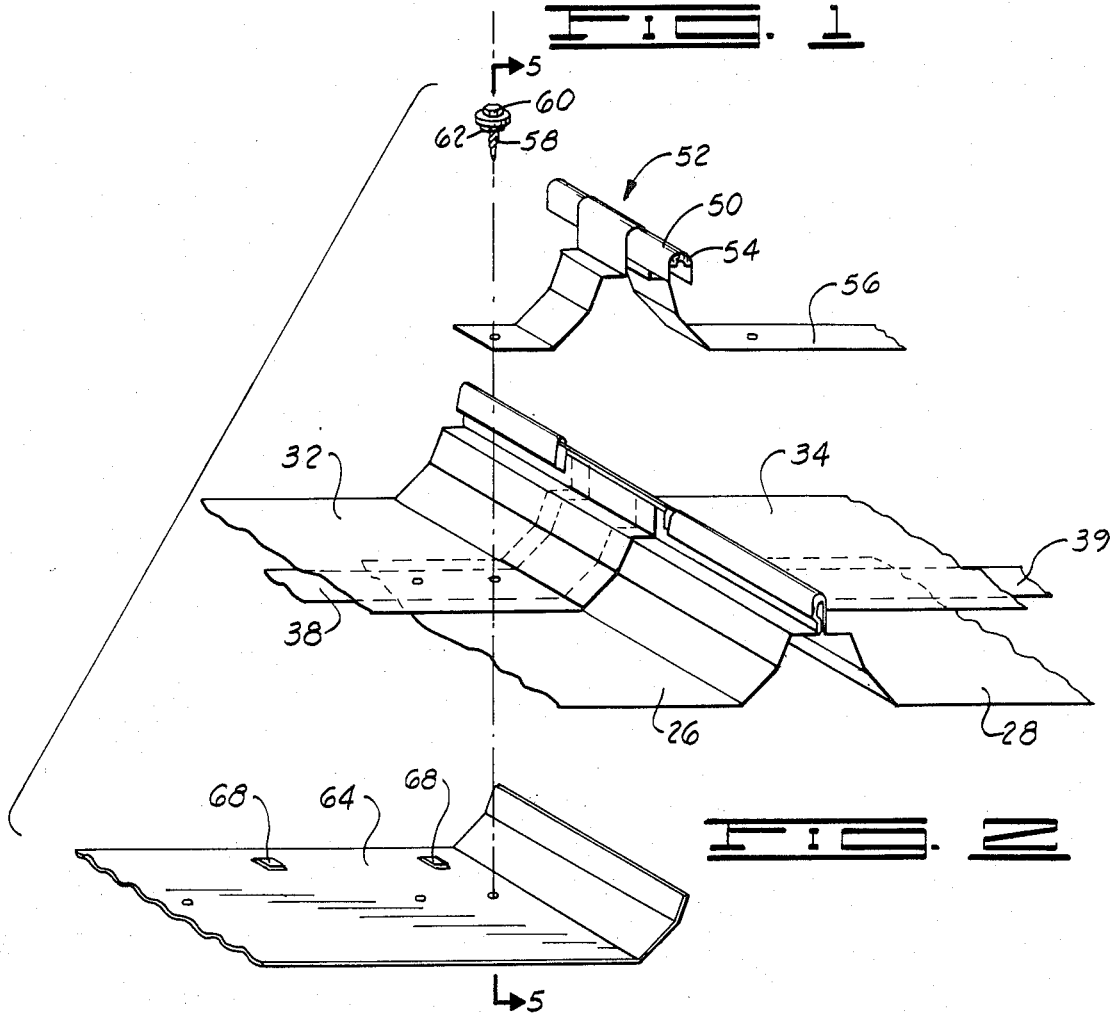
FIG. 2 is an exploded view showing an endlap and four corner junction of four adjacent panels, fragments of which are shown, of a standing seam roof assembly.

As shown in FIG. 2, the panel 26 is lapped by the panel 32 and a sealant strip 38 placed therebetween substantially as shown. Similarly, the panel 28 is lapped by the panel 34 and a sealant strip 39 placed therebetween substantially as shown. Factory punched holes are formed in the endlap portion of each of the panels 26, 28, 32 and 34 to ensure that the holes are coordinated and that the panels 26 and 28 are overlapped by the panels 32 and 34 by an amount sufficient to ensure that the sealant strips 38 and 39 (shown in FIG. 3) are brought into proper relationship while at the same time upstanding portions 44 and 46 of the panels 26 and 28 are separated a pre-selected distance from upstanding portions 48, 50 of the panels 32 and 34. A mastic cup 52 containing a mastic 54 is positioned in the space formed between the upstanding portion 46 of the panel 26 (i.e. the female member), and the upstanding portion 50 of the panel 34 (i.e. the female member) so that the mastic cup 52 is supported on the upstanding portions 44, 48 of the panels 28, 32 (i.e. the male members) and the mastic 54 contained within the mastic cup 52 can be extruded into the before-mentioned panel separations to seal the joint. The mastic cup 52 is secured in place by a cinch strap 56 having factory punched holes therein which are aligned with the endlap factory punched holes of the panels 26, 28, 32 and 34 such that a self-tapping screw 58 having a head portion 60 can be disposed through the aligned factory punched holes for securing the mastic cup 52 to the panels 26, 28, 32 and 34 via the cinch strap 56. A neoprene washer 62 (more clearly shown in FIG. 5) can be disposed between the head portion 60 of the self-tapping screw 58 and the panel 32 to further assure a watertight seal therebetween. While any suitable mastic can be employed as the mastic 54 in the mastic cup 52, the mastic will preferrably be of a composition that will deform and extrude into the gaps between overlapped panel edges in the notched area of the endlap so as to ensure a watertight seal.

The above description readily enables one to envision how the endlaps between the panels 26 and 32 and the end-laps between the panels 28 and 34 are accomplished. To further clarify the assembly of the building roof 10 a brief explanation of the order of assembly employing the panels 26, 28, 32 and 34 is set forth. In the assembly of the building roof 10 the panel 26 is positioned over the insulation batt 24, secured to the underlying secondary structural member, such as joist 22, and a backup plate 64 is placed under the end junction of the panel 26. Thereafter, the panel 32 is positioned over the insulation batt 24 so as to overlap the adjacent end portion of the panel 26 as heretofore described. The panel 28 is then positioned adjacently panel 26 over the insulation batt 24, secured, and a similar backup plate (not shown) is placed under the end junction of the panel 28. Thereafter, panel 34 is adjacently disposed to panel 28 such that the end portion of the panel 34 adjacent to the end portion of the panel 28 overlaps such end portion in the manner heretofore described. The backup plates, such as the backup plate 64 and the cinch strap 56, are provided with factory punched holes which are alignable with the factory punched holes in the panels of the roof assembly 10, such as panels 26, 32, so that upon alignment of the various components, the self-tapping screw 58 can be positioned therein to secure the components together.

Figure 5:
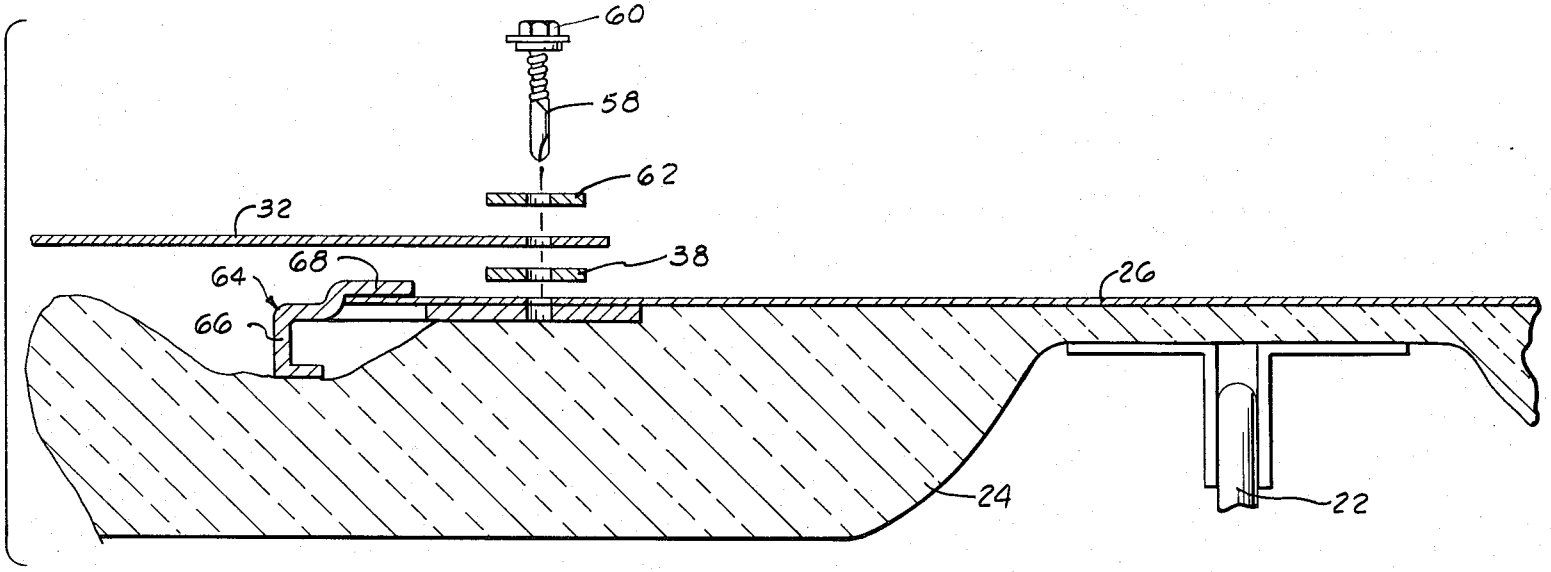
FIG. 5 is an enlarged, exploded sectional view of the endlap of the two corner junction of the standing seam roof assembly taken at 5—5 in FIG. 2.

Referring now to FIG. 5, a backup fitting 66 is formed as an integrally raised member 68 having a recess into which the end of the roof panel 26 passes. The backup fitting 66 is constructed so that it is clipped onto the panel 26 and remains there without aid or support from the adjacent joist while the endlap assembly is completed. The self-tapping screw 58 is adapted to coact with the neoprene washer 62 to secure the assembly and clamp the sealant strip 38 between the panels 26 and 32 of the roof assembly 10. The panel 28 and 34, which are identical in construction to the panels 26 and 32, are likewise interconnected with a backup fitting (not shown) and a self-tapping screw is adapted to coact with a neoprene washer to secure the assembly and clamp the sealant strip 39 between the panels 28 and 34 in a similar manner.

Figure 3:
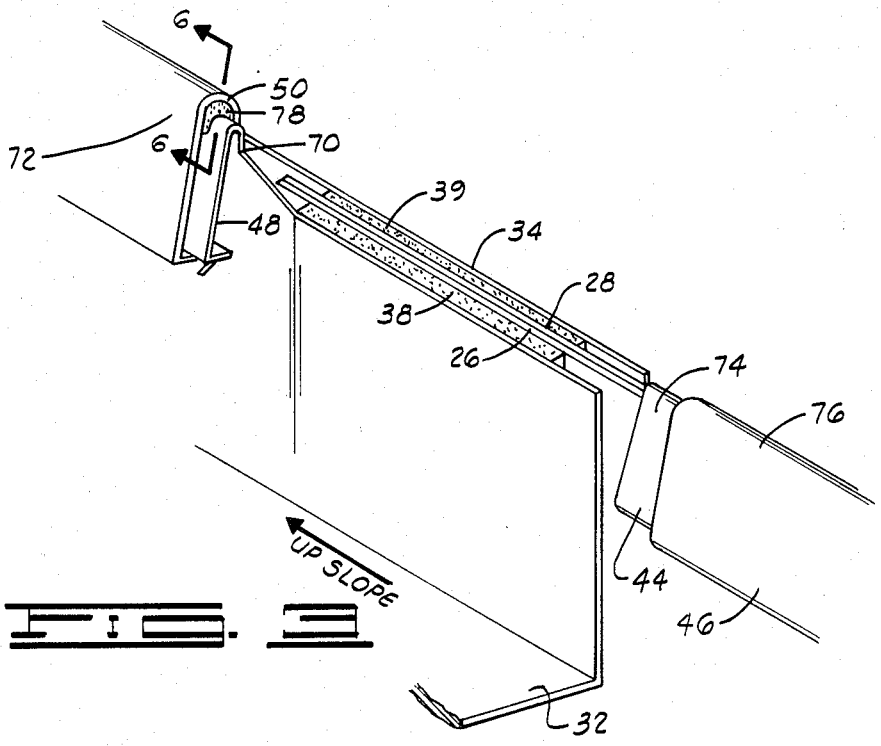
FIG. 3 is an enlarged, partially broken isometric view showing a portion of a four corner junction of a standing seam at area A in FIG. 1.
Figure 4:
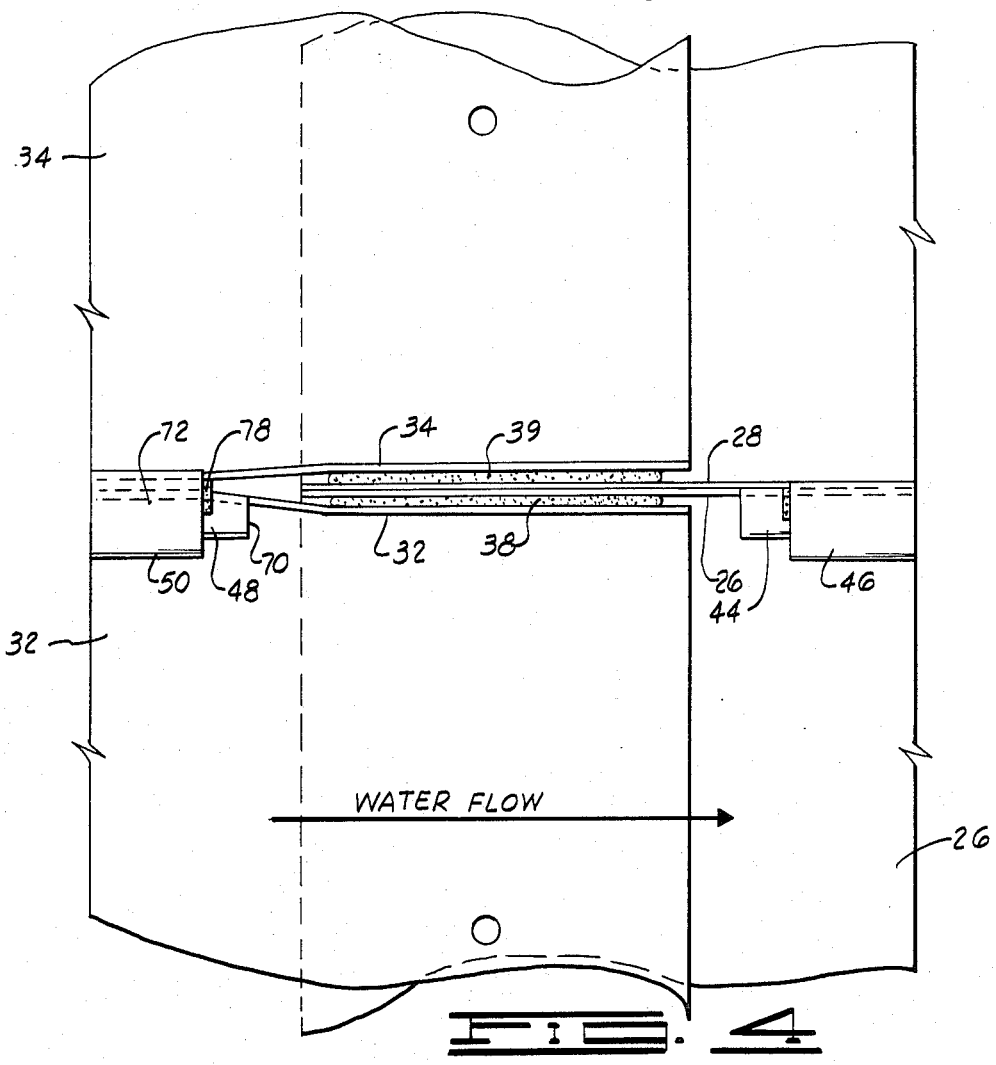
FIG. 4 is a plan view of the four corner junction of the standing seam shown in FIG. 3.

In an assembled position of the panels 26, 28, 32 and 34, a four corner junction is formed, such junction being illustrated in FIGS. 3 and 4. The mastic cup 52 containing the mastic 54 is clamped over the four corner junction to substantially seal same and provide a watertight junction. The upstanding portion 48 of the panel 32 is formed with a male member 70 and the upstanding portion 50 of the panel 34 is formed with a female member 72. Similarly, the upstanding portion 44 of the panel 26 is formed with a male member 74 and the upstanding portion 46 of the panel 28 is formed with a female member 76. Further, the ends of the panels 26, 28, 32 and 34 have been notched. The relationship between the notches when the panels of the roof assembly 10 are assembled in the field is controlled by aligning and inserting a fastener through the factory punched holes in the endlap portions of the panels as heretofore described. As previously stated, in the construction of the roof assembly 10 illustrated in the drawings, the panels 26 and 28 are adjacent to each other and extend to within the panels 32 and 34 as heretofore described. Further, the sealant strip 38 is placed between the panels 26 and 32 and the sealant strip 39 is placed between the panels 28 and 34. The mastic cup 52 covers the notched portion formed by the junction of the panels 26, 28, 32 and 34 and seals the entire assembly at such a four corner junction. The sealant strips 38 and 39 are exposed at that juncture as is a standing seam sealant 78 which protrudes slightly from a cavity formed between the male member of a panel, such as the male member 70 of the panel 32, and the female member of a panel, such as the female member 72 of the panel 34 when the male and female members of such panels are in an assembled position. Further, when the male and female members of the panel members are in the assembled position, the standing seam sealant 78, a resilient mastic material, is compressed and forced to protrude such that a watertight seal is formed between the interconnected male and female members of the panels. The protrusion of the standing seam sealant 78 from the cavity formed between the male and female members of the assembled panels enables the standing seam sealant 78 to contact the mastic 54 of the mastic cup 52 when the mastic cup 52 is in an assembled position and the mastic 54 contained therein is placed in a compressed condition.

The male and female members of the panels, such as the male member 70 of the panel 32 and the female member 72 of the panel 34, are constructed such that in an assembled position the male member 70 protrudes slightly past the end of the female member 72 as shown. The construction and interconnection of the male and female members of the panels and the mastic cup 52 is such that upon positioning the mastic cup 52 in the notched portion formed between the adjoining end portions of the four panels, the mastic cup 52 engages the protruding male members of the endlapped panels and the standing seam sealant 78 is forced to contact the mastic 54 in the mastic cup 52 and the sealant tape 38 and 39 disposed between the overlapped end portions of the panels to form a watertight three corner joint. The joint is extended to a four corner watertight joint when mastic (not shown) between the male member 74 of the panel 26 and the female member 76 of the panel 28 is included and extruded.

Figure 7:
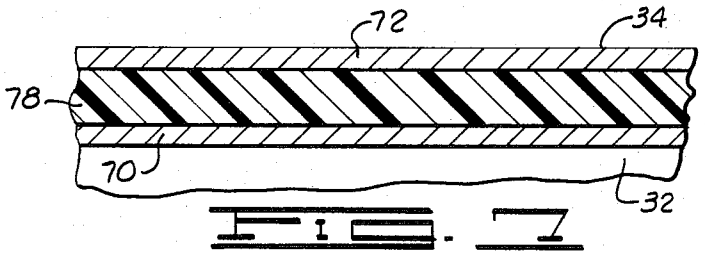
FIG. 7 is a fragmentary sectional view of the standing seam at 7—7 in FIG. 6.
Figure 5:
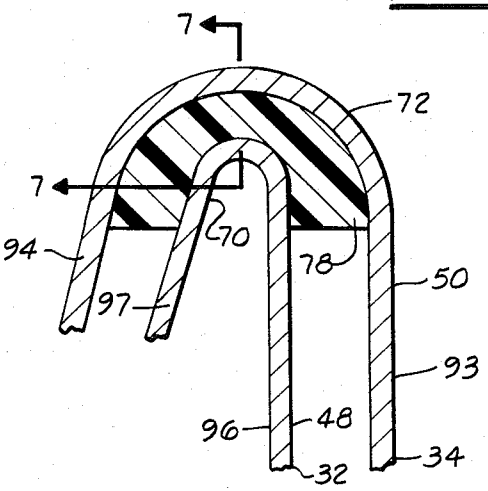

Referring now to FIGS. 6 and 7, the end relationship of the standing seam sealant 78 and the male and female members 70, 72 of the panels 32, 34, respectively, is illustrated in detail. The standing seam sealant 78 is positioned within a cavity formed between the male and female members of the panels forming the standing seam such that upon formation of a proper union between the male and female members the sealant 78 is compressed to form an effective watertight seal therebetween. The standing seams sealant 78 desirably will possess the following properties; adhesion, flexibility, water repellency and resiliency. Typical of a commercially available sealant which can be used as the standing seam sealant 78 is sold under the trademark "Q-41" by Q'SO, Inc., of Saginaw, Tex. The before-mentioned sealant is a blend of cross-linked ethylene-propylene terpolymer and other materials such as plasticizer and antioxidants. However, it is understood that this sealant employed as the standing seam sealant 78 can be any suitable sealant provided it has the desired properties of adhesion, flexibility, water repellency and resiliency so that upon compression the sealant forms a gasket. Further, the standing seam sealant 78 is preferably a foamed mastic which has a substantially constant durometer. A constant durometer assures easy field assembly of the panels of the roof assembly 10 throughout a wide range of field temperatures.

Figure 8:
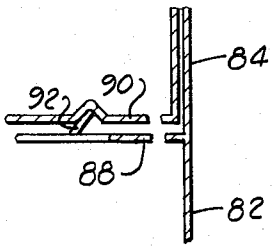
FIG. 8 is a partially broken isometric view of the standing seam roof assembly of FIG. 1 represented by the area B and illustrating a clip for permitting the roof assembly to float.

Referring now to FIG. 8, the roof assembly 10 further comprises a base member 80 and a clip member 82. The base member 80 is secured to the joist 22 by any suitable means, and the clip member 82 is slidably mounted in the base member 80. The clip member 82 comprises a pair of upwardly extending portions 84 having curved end portions 86 and a horizontally disposed portion 88 therebetween. The upstanding portion of each of the panels, such as the upstanding portion 44 of panel 26, is provided with a substantially horizontal portion 90 adapted to seat upon the substantially horizontal portion 88 of the clip member 82. The horizontal portion 88 of the clip member 82 is provided with a projection 92 adapted to bite into the horizontal portion 90 of the upstanding portion 44 of the panel 26. Thus, when the panels are assembled, the projection 92 bites into the horizontal portion 90 of the panel 26 and prevents the panel 26 from moving relative to the clip member 82 formed integrally with the upwardly extending portion 84 of the clip member 82 housed between the standing seam assembly.

Figure 9:
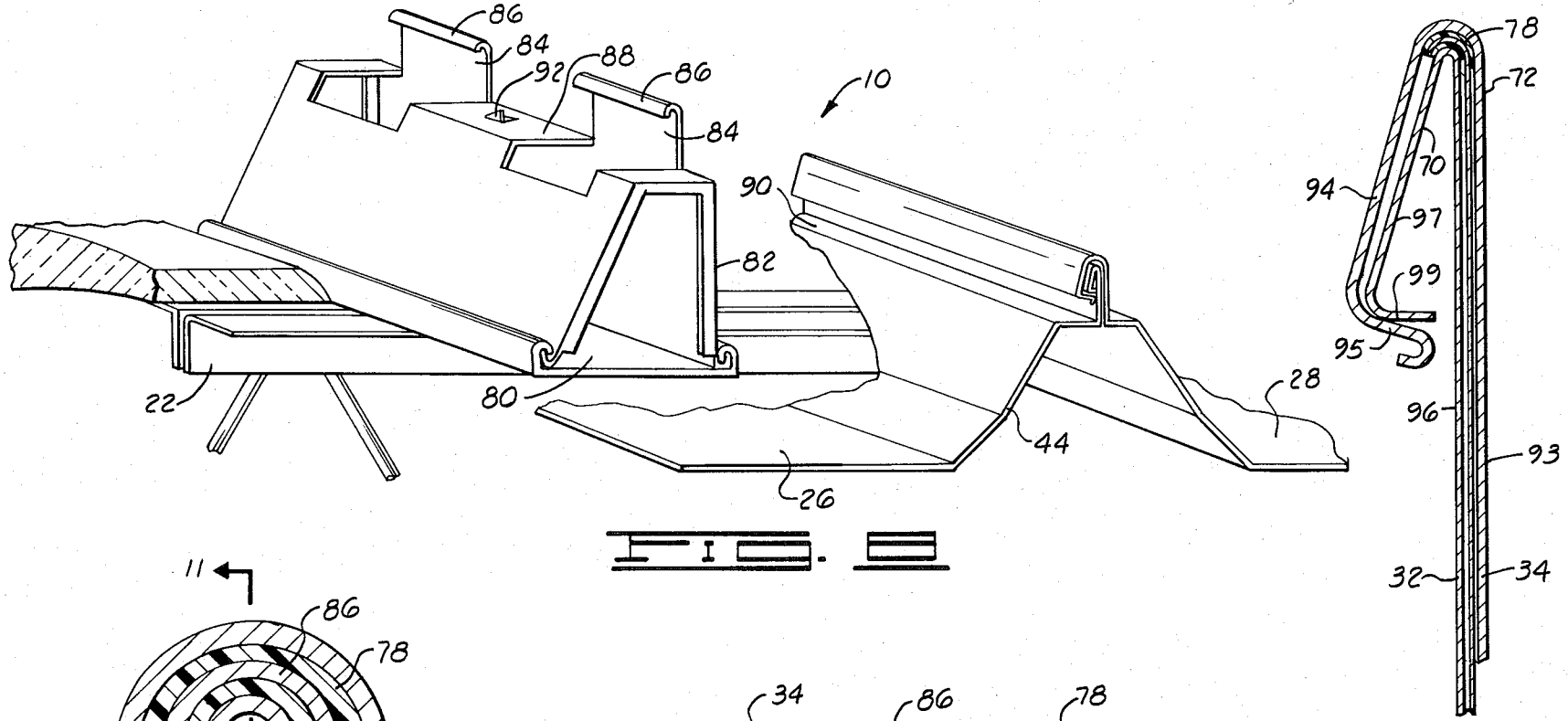
FIG. 9 is an enlarged, fragmentary sectional view of the standing seam roof assembly taken at line 9—9 in FIG. 1.

Referring now to FIG. 9, the interconnection of the female member 72 of the panel 34 and the male member 70 of the panel 32 to form the standing seam of the roof assembly 10 is illustrated. The female member 72 of the panel 34 is provided with an upstanding first portion 93 and a spatially disposed downwardly extending second portion 94 having a substantially horizontally disposed portion 95. The male member 70 of the panel 32 is also provided with an upstanding first portion 96 and a spatially disposed downwardly extending second portion 97 having a substantially horizontally disposed portion 99. The horizontally disposed portion 95 of the female member 72 of the panel 34 is configured so that the radius of the junction between the downwardly extending second portion 97 and the horizontally disposed portion 99 of the male member 70 of panel 32 will ride up the incline of the substantially horizontally disposed portion 95 of the female member 72 as the panels 32 and 34 are snapped together. Because the radius is substantially in contact with the substantially horizontally disposed portion 95 of the female member 72 for its full length a uniform pressure is brought to bear against the mastic. Other snap together panels not having this configuration exert unequal pressure on the mastic and allow a gap between the mastic and the top of the male corrugation which results in leaks. This coordinated action drives the upper end of the male member 70 of the panel 32 against the standing seam sealant 78 disposed within the upper end of the female member 72 of the panel 34 and creates a substantially uniform pressure against the standing seam sealant 78 for the full length of the joined sidelap. The arrangement is such that, when the male and female members 70, 72 of the panels 32, 34, respectively, are snapped together, the female member 72 of the panel 34 is forced upwardly and snaps back, while the horizontally disposed portion 95 of the female member 72 exerts spring pressure upwardly against the horizontally disposed portion 99 of the male member 70 of the panel 32. This action clamps the standing seam sealant 78 against the curvatures of the male and female members 70, 72 substantially as shown in FIGS. 6, 7, 10 and 11.

Figure 11:
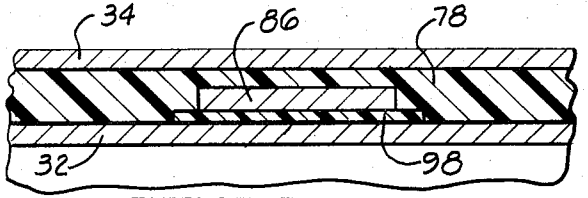
FIG. 11 is a fragmentary sectional view of the standing seam at 11—11 in FIG. 10.
Figure 10:
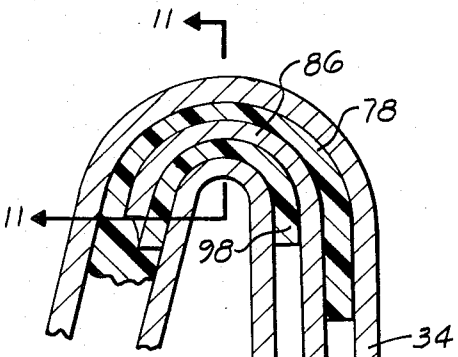
FIG. 10 is an enlarged, partially broken, cross sectional view of a standing seam with the clip of FIG. 8.

Referring now to FIGS. 9, 10 and 11, the clip member 82 extend upwardly between the male and female members of adjacent panels forming the standing seam portion of the roof assembly, such as the male and female members 70, 72 of the panels 32 and 34, such that the curved end portions 86 of the upwardly extending portions 84 of the clip member 82 curve around the upper portion of the male member of the panels. Sealant, such as tape 98, is positioned between the curved end portions 86 of the upwardly extending portion 84 of the clip member 82 and the curved upper portion of the male member 70 of the panel 32 substantially as shown in FIG. 10. The arrangement is such that the curved end portion 86 of the upwardly extending portion 84 of the clip member 82 is encapsulated by the standing seam sealant 78 and the tape 98.

In forming the standing seam metal floating roof assembly, self-tapping screws and resilient washers, such as screw 58 and neoprene washer 62 (illustrated in FIGS. 2 and 5) are employed. Further, prevention of relative motion between the clip and the panels forming the standing seam overcomes the working, kneading or degrading of the sealant. Thus, the unique construction of the standing seam metal floating roof assembly, when properly installed, enables all sealants to be kept under constant slight uniform pressure and dirt is prevented from reaching past the outside line of the sealants.

It will be further observed that, whenever sealant is applied, dirt, oil or film may intervene between the sealant and the panel itself. Thus, it is preferable to use a sealant in the form of mastic tapes having not only adhesion, but also resiliency. The placing of the mastic or sealant at the point of clip rotation allows the panels to be assembled, when they are snapped together, in a manner such that the sealant or mastic is not dislodged. Furthermore, this sealant has a tendency to become compressed because of repeated roof live loads, such as workers walking on the roof, snow and the like. With the advent of low-pitched roofs, it is more common for persons to walk on the roof. Furthermore, snow and ice tend to stay on the roof to a much greater extent than with the higher-pitched roofs formerly used. Under these conditions, the sealant function becomes extremely important in the life of the roof. The thickness of the mastic or sealant tapes should be sufficient to resist movement caused by expansion and contraction and various live load conditions without rupturing.

The improved standing seam floating roof assembly described above provides a sidelap joint for adjacent panels of the standing seam roof in which a resilient sealant is clamped under spring pressure between male and female members of the panel members, as well as an endlap joint between adjacent panels in which a sealant is clamped between the upper and lower panels. The unique four corner assembly enables one to seal the standing seam roof at this junction and ensure that no leakage will occur. Further, the unique clip for holding the metal roof to the secondary structural members enables the roof to float relative to the secondary structural members while preventing relative motion between the roof assembly and the clip.

While the standing seam floating roof assembly described above has overcome many of the disadvantages of the prior art roof assemblies, problems may nevertheless be encountered in the erection of the roof assembly due to human error, imperfections in the components as manufactured, or as a result of damage to the components during shipping and erection of the roof assembly. For example, a proper installation of the standing seam of the roof assembly is illustrated in FIGS. 9 and 10 of the drawings wherein the substantially horizontally disposed portion 99 of the male member 70 of the panel 32 is forced to slidably move on into contact with the horizontally disposed portion 95 of the female member 72 of the panel 34 until the male member 70 is positioned within the female member 72 as shown. A proper union between the male and female members 70, 72 of the adjacent panels 32, 34 insure proper seating of the male member 70 with the standing seam sealant in the upper end of the female member 72. However, in actual practice, the imperfections or defects in the fabrication of the various components may result in improper union between the male and female members of adjacent panels forming the standing seams. An improper union between adjacent panels forming the standing seam of the roof assembly results in uneven distribution of pressure against the standing seam sealant which often results in leaks in the roof assembly.

Figure 12:
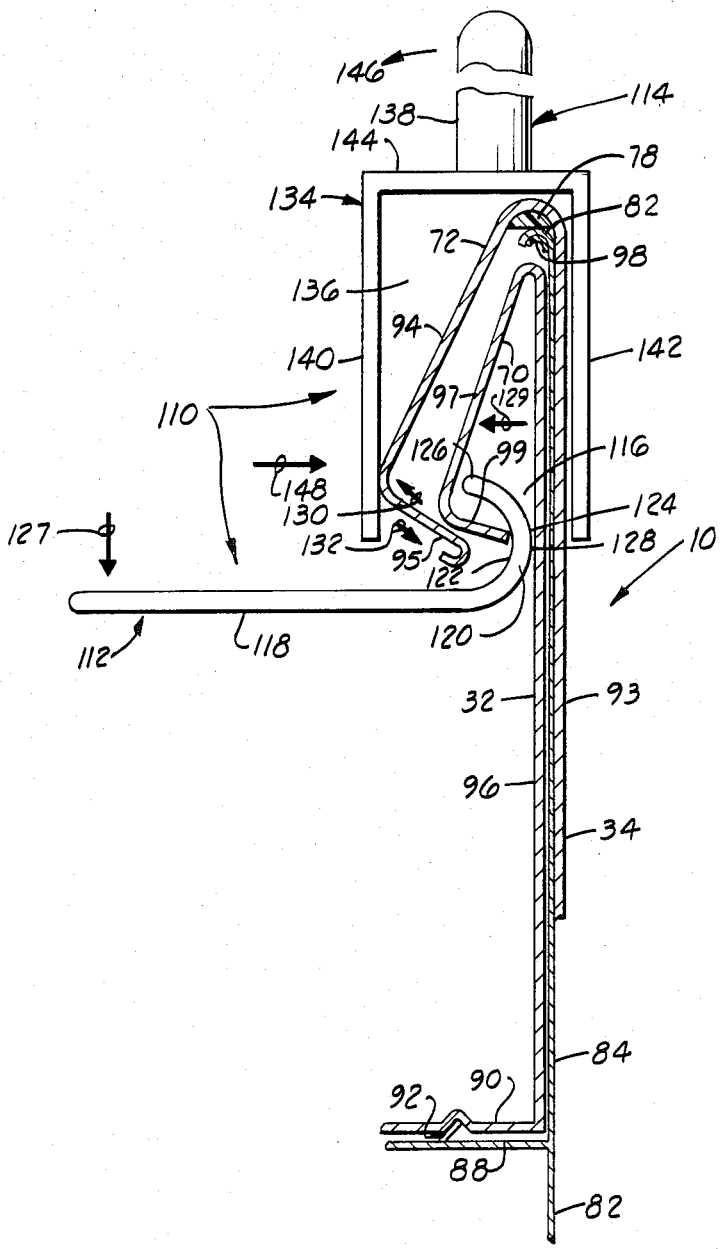
FIG. 12 is an enlarged, partially broken, cross sectional view of a standing seam wherein the male and female members of the panels forming the standing seam are improperly joined and illustrating an apparatus of the present invention for correcting the relationship of the male and female members to insure joint integrity therebetween.

Referring now to FIG. 12, a standing seam of the roof assembly 10 is illustrated where an improper union between the male and female members of adjacent panels is formed, such as the union between the male member 70 of the panel 32 and the female member 72 of the panel 34. The defective union between the male and female members of the standing seam is caused because the substantially horizontally disposed portion 99 of the male member 70 of the panel 32 has not traveled up the incline of the substantially horizontally disposed portion 95 of the female member 72. Thus, the male member 70 of the panel 32 does not engage the tape 98 contained within the curved end portions 86 of the clip member 82 or mastic 78 to form a seal therebetween as heretofore discussed. When the male and female members 70, 72 of the panels 32 and 34 are not properly joined as illustrated in FIG. 12, leaks in the roof assembly can readily occur. The improper union between adjacently disposed panels forming the standing seam, such as the union between the male and female members 70, 72 of the panels 32, 34 can be the result of imperfections in the components as manufactured, an excess of standing seam sealant 78 in the upper end of the female member 72 of the panel 34, damage to the components in shipping and handling, human error in the assembly of the standing seam roof assembly, and the like. In addition, even when the male and female members of adjacent panels are properly joined problems may be encountered because of the length of the panel members forming the standing seam roof assembly. For example, even when the male and female portions are properly joined to form the standing seam a wave-like characteristics may be developed along the length of the standing seam portion of the panel. The wave-like characteristics may also make the standing seam of the roof assembly subject to leaks. Thus, in the assembly of the standing seam roof it is desirable that the standing seam be adjusted to substantially eliminate the wave-like characteristics and to ensure that the standing seam sealant 78 is distributed substantially uniformly throughout the length of the standing seam.

The improper union between adjacently disposed male and female members of panels forming the roof assembly 10, such as the male member 70 of the panel 32 and the female member 72 of the panel 34, as well as the inherent problems in the standing seam of the roof assembly due to the wave-like characteristics often present in an assembled standing seam roof assembly, can be overcome by employing an apparatus 110 constructed in accordance with the present invention.

Figure 15:
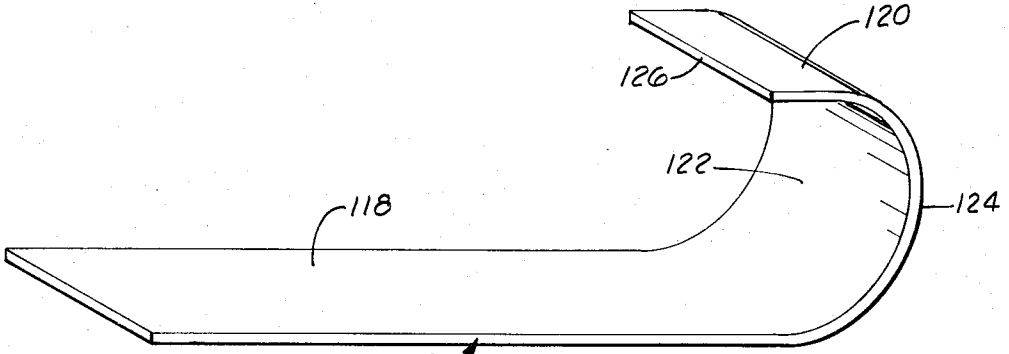
FIG. 15 is an isometric view of a portion of the standing seam roof assembly showing the first hand implement of the present invention positioned within the standing seam to ensure joint integrity of the standing seam formed by union of the male and female members of adjacently disposed panels.

The apparatus 110 comprises a first hand implement 112 and a second hand implement 114. In many instances the first hand implement 112 can be employed independent of the second hand implement 114 for correcting the improper union between the male and female members of adjacently disposed panels forming the standing seam. Further, the first hand implement 112 can be positioned within a recessed portion 116 of the male portion of the roof panel forming the standing seam, such as the male member 70 of the panel 32 (as shown in FIGS. 12 and 15) so that upon movement of the first hand implement 112 along the length of the standing seam formed between the adjoined male and female members the wave-like characteristics and imperfections which may be present within the standing seam are readily identified and/or corrected and the integrity of the joint substantially enhanced because the standing seam sealant 78 will be substantially uniformly distributed and compressed along the length of the standing seam of the building roof 10. Thus, the first hand implement 112 is employed not only to correct improper unions between male and female members of adjacent panels forming the standing seam (as illustrated in FIG. 12), but the first hand implement 112 is also employed to ensure quality control and joint integrity of the standing seam formed between the male and female members of adjacently disposed panels throughout the length of the standing seam.

Figure 13:
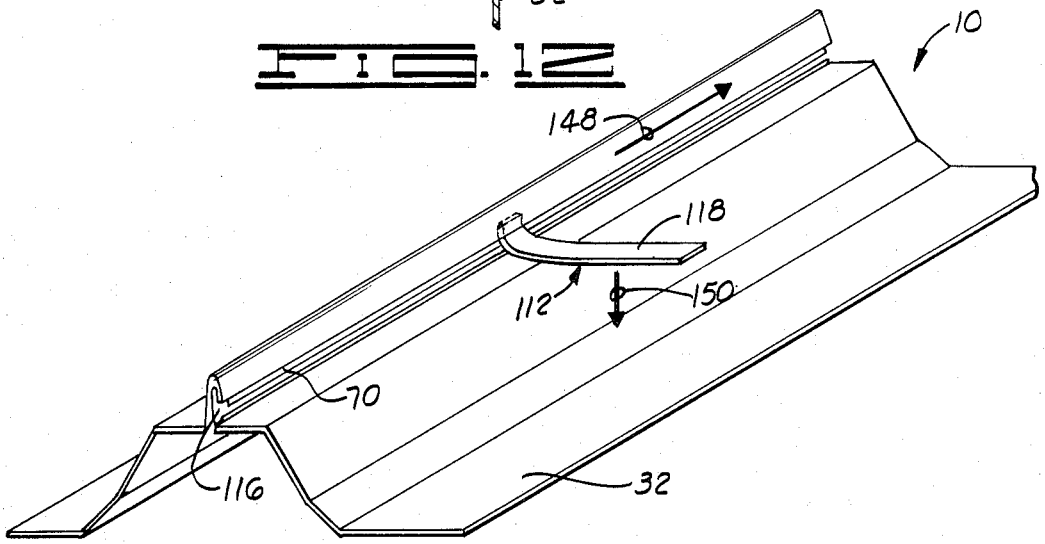
FIG. 13 is an isometric view of a first hand implement of the present invention employed to ensure joint integrity between the male and female members of adjacently disposed panels forming the standing seam.

Referring now to FIGS. 12 and 13, the first hand implement 112 comprises an elongated body portion 118 and an extension engaging member 120 supported by the body portion 118 at one end thereof. The extension engaging member 120, illustrated as having an arcuate configuration, is provided with an extension engaging surface 122, an opposed male engaging surface 124, and an end portion 126. Thus, upon positioning the extension engaging member 120 in the recessed portion 116 of the male member of the roof panel, the extension engaging surface 122 partially encompasses the substantially horizontally disposed portions 95, 99 of the female and male members 72, 70, the male engaging surface 124 of the extension engaging member 120 is disposed adjacent the upstanding portion 96 of the male member 70, and the end portion 126 is disposed in close proximity to the downwardly extending second portion 97 of the male member 70 at a position above the horizontally disposed portion 99 as shown. When the extension engaging member 120 of the first hand implement 112 is positioned within the recessed portion 116 of the male member 70 as described above, force can be placed on the elongated body portion 118 of the first hand implement 112 in the direction of the arrow 127. Application of the force on the elongated body portion 118 of the first hand implement 112 in the direction of the arrow 127 causes the first hand implement 112 to pivot about a point 128 so that the end portion 126 of the extension engaging member 120 contacts the downwardly extending second portion 97 of the male member 70 and creates a force on the second portion 97 of the male member 70 in the direction of the arrow 129. The movement of the downwardly extending portion 99 of the male member 70 by the pressure exerted in the direction of the arrow 129 causes the horizontally disposed portion 99 of the male member 70 to slide along the upper surface of the substantially horizontally disposed portion 95 of the female member 72 in the direction indicated by the arrow 130.

In many situations the spring-like nature of the female member 72 will cause the female member 72 to move in the direction indicated by the arrow 132 once the male member 70 has commenced movement in the direction indicated by the arrow 130. The combined movement of the male member 70 along the upper surface of the substantially horizontally disposed portion 95 of the female member 72 in the direction represented by the arrow 130 and the movement of the female member 72 in the direction represented by the arrow 132 because of its resilient characteristics, will cause the male member 70 to move into proper seating engagement with the tape 98 and with the female member 72 substantially as shown in FIGS. 9 and 10.

In certain instances the movement of the male member of the roof panel forming the standing seam roof assembly via the use of the first hand implement 112 as described above may not be sufficient to form a proper union between the male and female members of the adjacently disposed panels forming the standing seam roof assembly. This situation can occur in those instances where an excess of the standing seam sealant 78 has been disposed in the upper portion of the female member of the panel, such as the female member 72 of the roof panel 34, or when the female member of the roof panel has been sprung or otherwise damaged. In such instances the second hand implement 114 is used in combination with the first hand implement 112 to create a counter force on the male and female members 70, 72 and thus ensure a proper union between the male and female members of adjacent panels forming the standing seam.

Figure 14:
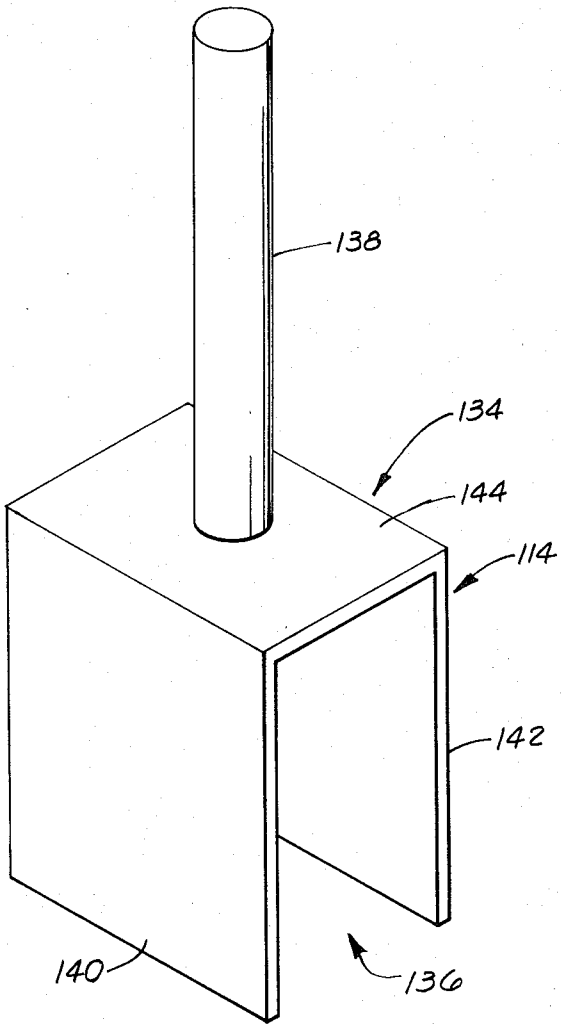
FIG. 14 is an isometric view of a second hand implement useful in combination with the first hand implement illustrated in FIG. 13 to ensure proper union of the male and female members of adjacently disposed panels in the formation of the standing seam.

Referring now to FIGS. 12 and 14, the second hand implement 114 comprises a substantially U-shaped housing 134 having an opening 136 formed therein and a handle 138. The housing 134 is formed of a first side plate 140, a spatially disposed second side plate 142 and an upper plate 144 interconnecting the first and second side plates 140 and 142 such that the opening 136 is formed therebetween. The width, height and length of the opening 136 formed within the housing 134 can vary widely. However, it is desirable that the width of the opening 136 substantially correspond to the width of the female member of the panel forming the standing seam roof assembly, such as the female member 72 of the panel 34 when the female member 72 is in an improper union with the male member 70 of the panel 32 substantially as shown in FIG. 12. The height of the opening 136 is desirably sufficient to enable the housing 136 to be positioned over the upper portion of partially connected male and female members of the panels forming the standing seam while allowing insertion of the first hand implement 112 as heretofore described. The length of the opening 136 will be dependent solely upon the overall length of the housing 134 of the second hand implement 114. Thus, the dimensions of the opening 136 are not critical provided the opening 136 is designed to compensate and receive the male and female members of the panels forming the standing seam roof assembly as heretofore described. The handle 138 is secured at one end to the upper plate 144 of the housing 134 so as to extend therefrom substantially as shown. The length of the handle 138 can vary widely, the only requirement being that the handle 138 be of sufficient length so that a workman can grasp the handle and rotate the second hand implement 134 in the direction of the arrow 146 when the housing 134 of the second hand implement 114 is disposed over the male and female portions of adjacently disposed panels forming the standing seam.

In FIG. 12 the second hand implement 114 is illustrated as being disposed over the male and female members 70, 72 of the panels 32, 34 forming the standing seams such that the first hand implement 112 is positionable within the recess portion 116 of the male member 70. In order to provide for a proper union between the male and female members 70, 72 of the panels 32, 34, a force is applied to the handle 138 of the second hand implement 114 in the direction represented by the arrow 146 while a force is directed on the elongated body portion 118 of the first hand implement 112 in the direction of the arrow 127. The combination of forces in the direction of the arrows 127, 146 causes the end portion 126 of the extension engaging member 120 of the first hand implement 112 to engage the downwardly extending second portion 97 of the male member 70 of the panel 32 as the extension engaging member 120 is pivoted about the point 128 so that the male member 70 is caused to slidably move along the horizontally disposed portion 95 of the female member 72 of the panel 34 in the direction of the arrow 130. At the same time, the force applied to the second hand implement 114 in the direction represented by the arrow 146 causes the first side plate 140 of the housing 134 of the second hand implement 114 to engage the downwardly extending second portion 95 of the female member 72 of the panel 34 and apply a force thereto in the direction represented by the arrow 148. During rotation of the second hand implement 114 the second side plate 142 of the housing contacts an upstanding first portion 93 of the female member 72 of the panel 34. Thus, the combination of the forces exerted upon the male and female members 70, 72 is in opposite directions which results in the movement of the female member 72 in the direction represented by the arrow 132 and the movement of the male member 70 in the direction of the arrow 130 so that the male and female members 70, 72 of the panels 32, 34 are properly joined as illustrated in FIGS. 9 and 10.

As previously stated, during the formation of a standing seam, even when the male and female portions of the standing seam appear to have made a proper union, problems may nevertheless be encountered due to the wave-like characteristics which may be present in the standing seam throughout its length. To ensure the joint integrity of the standing seam, and thus the watertightness of the seal formed between the male and female members of the adjacently disposed panel forming the standing seam, the extension engaging member 120 of the first hand implement 112 can be disposed within the recessed portion 116 of the male member of the roof panel forming the standing seam, such as the male member 70 of the panel 32 as shown in FIG. 15. In such instance, the first hand implement 112 is desirably moved along the length of the standing seam, such as in the direction represented by the arrow 148. As this movement takes place the end portion 126 of the first hand implement 112 will intersect portions of the male member 70 which are out of position and not properly joined with the female member 72 because of the wave-like configuration of the male member 70 or defects in the fabrication of the male and female members 70, 72. When an improper union between the male and female members 70, 72 is encountered by the end portion 126 of the first hand implement 112 a downward force in the direction of the arrow 150 on the elongated body portion 118 of the first hand implement 112 can be exerted and the male and female members 70, 72 brought into proper union. The downward force exerted on the elongated body portion 118 can be continuous as the extension engaging member 120 is slidably moved through the recessed portion 116 of the male portion 70 of the standing seam for substantially the full length thereof, or an intermittent force can be exerted on the elongated body portion 118.

The amount of force applied to the elongated body portion 118 of the first hand implement 112 can vary widely. However, care should be exercised to ensure that the force is only sufficient to ensure the proper union of the male and female members of the adjacently joined roof panels forming the standing seam. In other words, excess force should be avoided in order to prevent damage to the standing seam. Thus, the movement of the first hand implement 112 through the recess portion 116 formed in the male member of the panel member forming the standing seam will substantially correct imperfections formed in the standing seam which may result from the wave-like characteristics and imperfections and substantially enhance the integrity of the joint as formed.

It is clear that the present invention is well-adapted to carry out the objects and to attain the ends and advantages mentioned therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. An apparatus for enhancing joint integrity of a seam formed by union of adjacently disposed panels wherein one panel is provided with a female member and the other panel is provided with a male member, the female member adapted to receive the male member in a locking relationship such that a recessed portion is formed within the male member, the apparatus comprising:

first hand implement means positionable within the recessed portion of the male member for selectively moving the male member into a seating, substantially watertight sealing relationship with the female member when force is applied to the male member via the first hand implement means; and second hand implement means for exerting force on the female member in a direction substantially opposite the force exerted on the male member via the first hand implement means, the second hand implement means positionable over the female member such that upon application of force to the second hand implement means the second hand implement means cooperates with the first hand implement to selectively move the male member into a union with the female member.

2. The apparatus of claim 1 wherein the female member comprises an upstanding first portion and a spatially disposed downwardly directed second portion, the male member comprises an upstanding first portion and a spatially disposed downwardly directed second portion, the first and second portions of the male member defining the recessed portion formed therein, and wherein the first hand implement means comprises:

an elongated body member having an extension engaging member formed thereon, the extension engaging member positionable within the recessed portion of the male member such that the body member extends outwardly therefrom and upon application of force on the body member the extension engaging member contacts the downwardly directed second portion of the male member and causes same to move into a locking relationshihp with the female member.

3. The apparatus of claim 1 wherein the female member is provided an upstanding first portion and a downwardly directed second portion having a substantially horizontally disposed portion formed thereon, the male member is provided with an upstanding first portion and a spatially disposed downwardly extending second portion, the male member being disposable within the female member, and wherein the first hand implement means comprises:

an elongated body member and extension engaging member supported on one end of the body member, the extension engaging member slidably positionable with the recessed portion of the male member such that the extension engaging member partially encompasses the substantially horizontally disposed portion of the female member as the first hand implement is moved through the recessed portion of the male member and selectively engages the downwardly directed second portion of the male member for moving the male member into union with the female member of the seam.

4. The apparatus of claim 3 wherein the body member extends outwardly from the seam formed by union of the male and female members, and wherein the extension engaging member is an arcuate shaped member having an extension engaging surface, a male engaging surface and an end portion, the extension engaging surface adapted to engage at least a portion of the horizontally disposed portion of the female member and the downwardly directed second portion of the male member, a male engaging surface adapted to engage the upstanding first portion of the male member, and the end portion adapted to engage the downwardly directed second portion of the male member as force is applied to the body member to selectively move the male member into locking union with the female member.

5. An apparatus for enhancing joint integrity of a seam formed by union of adjacently disposed panels wherein one panel is provided with a female member, and the other panel is provided with a male member, the female member adapted to receive the male member in a locking relationship such that a recessed portion is formed within the male member, the apparatus comprising:

first hand implement means positionable within the recessed portion of the male member for selectively moving the male member into a seating, substantially watertight sealing relationship with the female member when force is applied to the male member via the first hand implement means; and second hand implement for exerting force on the female member in a direction substantially opposite the force exerted on the male member via the first hand implement means, the second hand implement means positionable over the female member such that upon application of force to the second hand implement means the second hand implement means cooperates with the first hand implement to selectively move the male member into a union with the female member, the second hand implement means comprising a substantially U-shaped housing having an opening therein adapted to receive at least a portion of the female member, and a handle supported by the housing.

6. The apparatus of claim 5 wherein the U-shaped housing of the second hand implement comprises a first side plate, a spatially disposed side plate and an upper plate disposed between and interconnecting the first and second side plates such that the opening is formed therebetween.

7. The apparatus of claim 6 wherein the handle of the second hand implement is secured to the upper plate of the U-shaped housing.

8. A method for enhancing joint integrity of a seam formed by union of adjacently disposed panels wherein one of the panels is provided with a female member, the other panel is provided with a male member having an upstanding first panel portion and a spatially disposed downwardly extending second portion, the female member adapted to receive the male member so that a recessed portion is formed between the upstanding first portion and the spatially disposed downwardly extending second portion of the male member, the method comprising the steps of:

positioning a first hand implement within the recessed portion formed in the male member; and applying a force to the first hand implement such that the downwardly extending second portion of the male member is moveable in a direction away from the upstanding first portion of the male member and up into the female member.

9. The method of claim 8 wherein the first hand implement is moved through the recessed portion of the male member while maintaining substantially constant force thereon.

10. The method of claim 8 wherein the first hand implement is moved through the recessed portion of the male member until encountering an improperly coupled portion of the male and female members whereupon force is applied to the first hand implement to selectively move the male member into locking engagement with the female member.

11. The method of claim 8 further comprising:

positioning a second hand implement over at least a portion of the female member so as to be disposed substantially above the first hand implement; and applying a force on the female member via the second hand implement in the direction of the first hand implement while the force is being applied to the male member in an opposite direction via the first hand implement.

12. A method for enhancing joint integrity of a seam formed by union of adjacently disposed panels wherein one of the panels is provided with a female member, the other panel is provided with a male member having an upstanding first panel portion and a spatially disposed downwardly extending second portion, the female member adapted to receive the male member so that a recessed portion is formed between the upstanding first portion and the spatially disposed downwardly extending second portion of the male member, the method comprising:

positioning a first hand implement within the recessed portion formed in the male member; and moving the first hand implement through the recessed portion of the male member until encountering an improperly coupled portion of the male and female members whereupon force is applied to the first hand implement to selectively move the male member into proper union with the female member.

13. The method of claim 12 further comprising:

positioning a second hand implement over at least a portion of the female member so as to be disposed substantially above the first hand implement; and applying a force on the female member via the second hand implement in the direction of the first hand implement while the force is being applied to the male member in an opposite direction via the first hand implement.

* * * * *